US007175334B2

(12) United States Patent
Babson et al.

(10) Patent No.: US 7,175,334 B2
(45) Date of Patent: Feb. 13, 2007

(54) VESSEL AGITATOR ASSEMBLY

(75) Inventors: Arthur L. Babson, Chester, NJ (US); Thomas Palmieri, Paramus, NJ (US)

(73) Assignee: DPC Cirrus, Inc., Flanders, NJ (US)

( * ) Notice: Subject to any disclaimer, the term of this patent is extended or adjusted under 35 U.S.C. 154(b) by 189 days.

(21) Appl. No.: 10/813,576

(22) Filed: Mar. 31, 2004

(65) Prior Publication Data

US 2005/0219944 A1 Oct. 6, 2005

(51) Int. Cl.
*B01F 11/00* (2006.01)

(52) U.S. Cl. ..... 366/109; 366/209; 366/218

(58) Field of Classification Search ..... 366/209, 366/218, 109; 422/63–66
See application file for complete search history.

(56) References Cited

U.S. PATENT DOCUMENTS 485,999 A * 11/1892 Timby ..... 99/277.2
496,759 A * 5/1893 Timby ..... 99/277.2
802,254 A * 10/1905 Baker et al. ..... 99/364
985,802 A * 3/1911 Flounders et al. ..... 126/211
1,519,153 A * 12/1924 Mitton ..... 366/109
2,415,782 A * 2/1947 Zademach et al. ..... 366/218
5,686,243 A * 11/1997 Royer et al. ..... 435/6
6,837,843 B2 * 1/2005 Gazeau et al. ..... 494/10

* cited by examiner

*Primary Examiner*—David Sorkin
(74) *Attorney, Agent, or Firm*—Whitham, Curtis, Christofferson & Cook, P.C.

(57) ABSTRACT

A test vessel agitator assembly that agitates test vessels and the contents therein within an immunoassay automated analyzer system. The test vessels are transported along an element that is comprised of ridges and troughs such that the test vessel is moved in a directions that is approximately perpendicular to the direction of transportation.

8 Claims, 5 Drawing Sheets

VESSEL AGITATOR ASSEMBLY

BACKGROUND OF THE INVENTION

1. Field of the Invention

The present invention generally relates to an agitator assembly for shaking vessels that are present in a transportation assembly within an automated immunoassay analyzer system.

2. Background Description

Immunoassay analyzer systems perform chemical tests to determine the presence of a specific antibody or antigen in a sample of biological material such as blood or urine. During the performance of these tests, automated analyzers dilute samples, add reagents, agitate and incubate the test vessels. Agitation is required to mix the samples with the reagent. The agitation also assists to increase the reaction rate when one of the reagents is bound to a solid phase which can be the interior surface of the assay tube itself or a bead or a suspension of microparticles. Current agitator implementations may provide fins within a vessel, such as the dilution well, as described in Babson et al. U.S. Pat. No. 5,723,092, actively impact the vessels as in Babson et al. U.S. Pat. No. 5,885,529, or shake the vessels as in Babson et al. U.S. Pat. No. 5,316,726.

SUMMARY OF THE INVENTION

It is an object of the invention to provide an apparatus and method to perform agitation of test vessels in an automated immunoassay analyzer in a simple, passive manner.

It is another object of this invention to provide an apparatus and method to perform agitation within an incubation chamber.

It is still another object of the invention to provide an apparatus and method to perform agitation of vessels used in an automated immunoassay analyzer which reduces the requirements for specialized tubes or tube processing equipment.

According to the invention, an agitator assembly is provided within a transportation assembly of the automated immunoassay analyzer (e.g., a carousel, belt, chain, or other device which moves vessels between stations). The test vessel agitator assembly allows test vessels to be placed in and removed from the transportation assembly. While test vessels are being transported within the automated immunoassay analyzer via the transportation assembly, the test vessels are passively bumped by the agitator assembly, thereby agitating the contents. This agitation can occur when the test vessel contains a variety of different samples (e.g., blood, plasma, urine, serum, etc.), as well as a variety of other constituents such as diluted samples, reagent, assay bead and/or the like.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
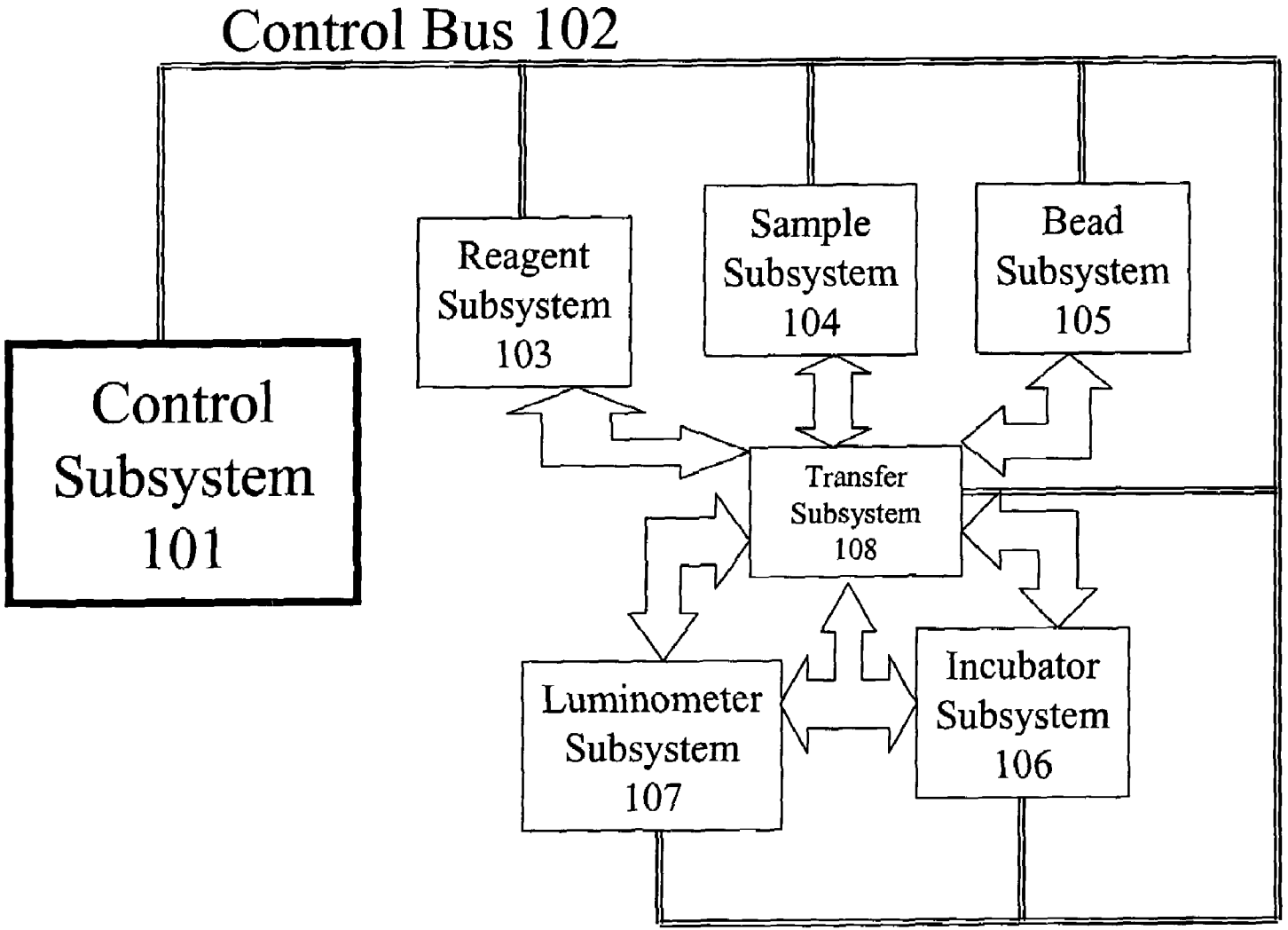
FIG. 1 is an overview of an automated immunoassay analyzer.

Referring now to the drawings, and more particularly to FIG. 1, which shows an automated immunoassay analyzer as a complex system with numerous subsystems that allow the tests to be performed without the continuous monitoring and intervention of a technician. The technician selects the tests to be performed for each sample and enters this information via the control subsystem 101. The control subsystem 101 manages the other subsystems by sending command and control information via the control bus 102. Samples of biological material (e.g., blood, urine, plasma, etc.) are placed by the technician in the sample subsystem 104. The samples within the sample subsystem 104 can be diluted prior to making measurements or can be tested in the undiluted state depending on direction from the control subsystem 101. The bead subsystem 105 adds the appropriate substrate having a bound "analyte binding compound" to the test vessel. Preferably, the substrate is present in the form of one or more beads having adhered thereto a compound for binding the analyte of interest from the sample under test (e.g., via antigen-antibody binding, etc.). The reagent subsystem 103 adds the specified reagent to the test vessel. The selection of bead and reagent for each sample is managed by the control subsystem 101 based on the type of test to be performed on each sample. These subsystems include identification capabilities such as, for example, bar code readers or RF readers that read the bar code or RFID identification information on the reagent containers, bead containers and sample containers to ensure the correct components are added to each test vessel for testing. The test vessel is moved within the analyzer via the transfer subsystem 108. Once the selected components are added to the test vessel, the incubator subsystem 106 incubates and agitates the test vessel as managed by the control subsystem 101. The preferred incubator operation is described in more detail in the co-pending application, Multipath Incubator Ser. No. 10/813,604; however, it should be understood that this invention can be employed in numerous incubator and non-incubator applications (e.g., luminometer subsystem, or region prior to or after the incubator) depending on the design requirements for the vessel transportation assembly. The vessel is then washed and transferred via the transfer subsystem 108 to the luminometer subsystem 107. The luminometer subsystem 107 selects the test vessel and presents it to the detection mechanism. The luminometer operation is described in more detail in the co-pending application, "Rotary Luminometer," Ser. No. 10/813,575; however, it should be understood that this invention can be used in combination with a variety of devices that make readings on components within a test vessel (e.g., devices that read fluorescence, chemiluminescence, phosphorescence, and/or color). After the read operation is performed, the test vessel is discarded.

Figure 2:
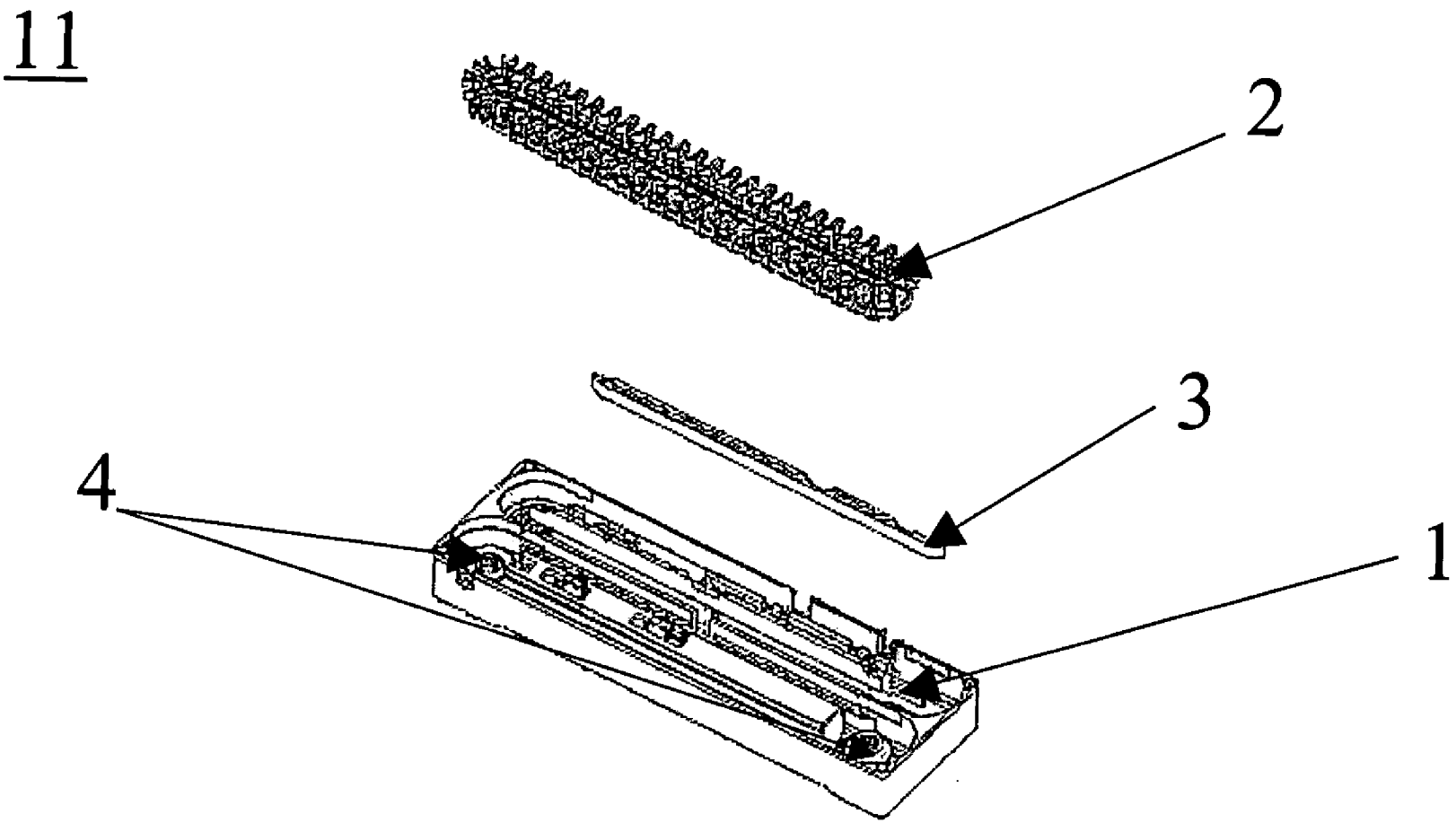
FIG. 2 is an expanded view of the transportation assembly.

Referring now to FIG. 2, there is shown an expanded view of a preferred embodiment of the automated immunoassay analyzer transportation assembly 11. Within the transportation assembly 11, the transportation assembly base 1 contains the test vessel agitator 3 mounted against the side wall of the transportation assembly base 1. However, it should be understood that in some applications of the inventions, the test vessel agitator 3 may be free standing or not affixed to assembly base 1. The conveyor element 2 is also mounted in the transportation assembly base 1. The conveyor element 2 is preferably mounted such that it is able to rotate around the mounting wheels 4 that hold the conveyor element 2 in the transportation assembly base 1. However, it should be understood that the path to be traveled by the conveyor element 2 can vary considerably within the practice of this invention and that in some applications traversing around mounting wheels may not be required (e.g., a simple back and forth pathway). In addition, the transportation assembly base 1 allows test vessels (not shown) to be placed in and removed from the test vessel transportation assembly 11.

Figure 3:
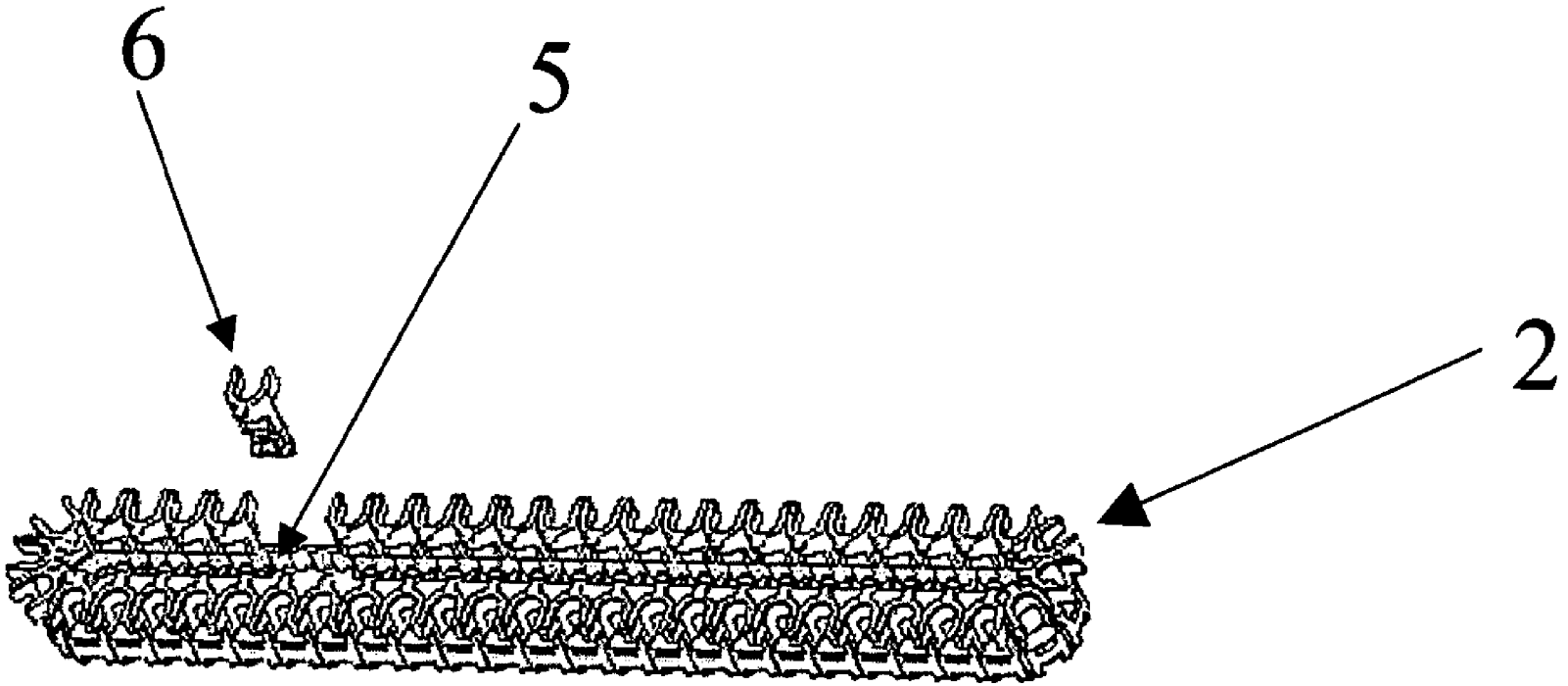
FIG. 3 shows the test vessel conveyor element.

The conveyor element 2, shown in FIG. 3, preferably comprises multiple test vessel holders 6 attached together on a flexible belt 5. It is the belt 5 that is rotated around the mounting wheels 4 and the test vessel holders 6 that travel adjacent to the test vessel agitator 3. The number of test vessels, the holders 6, and the configuration of test vessel holders 6 can vary within the practice of this invention.

Figure 4:
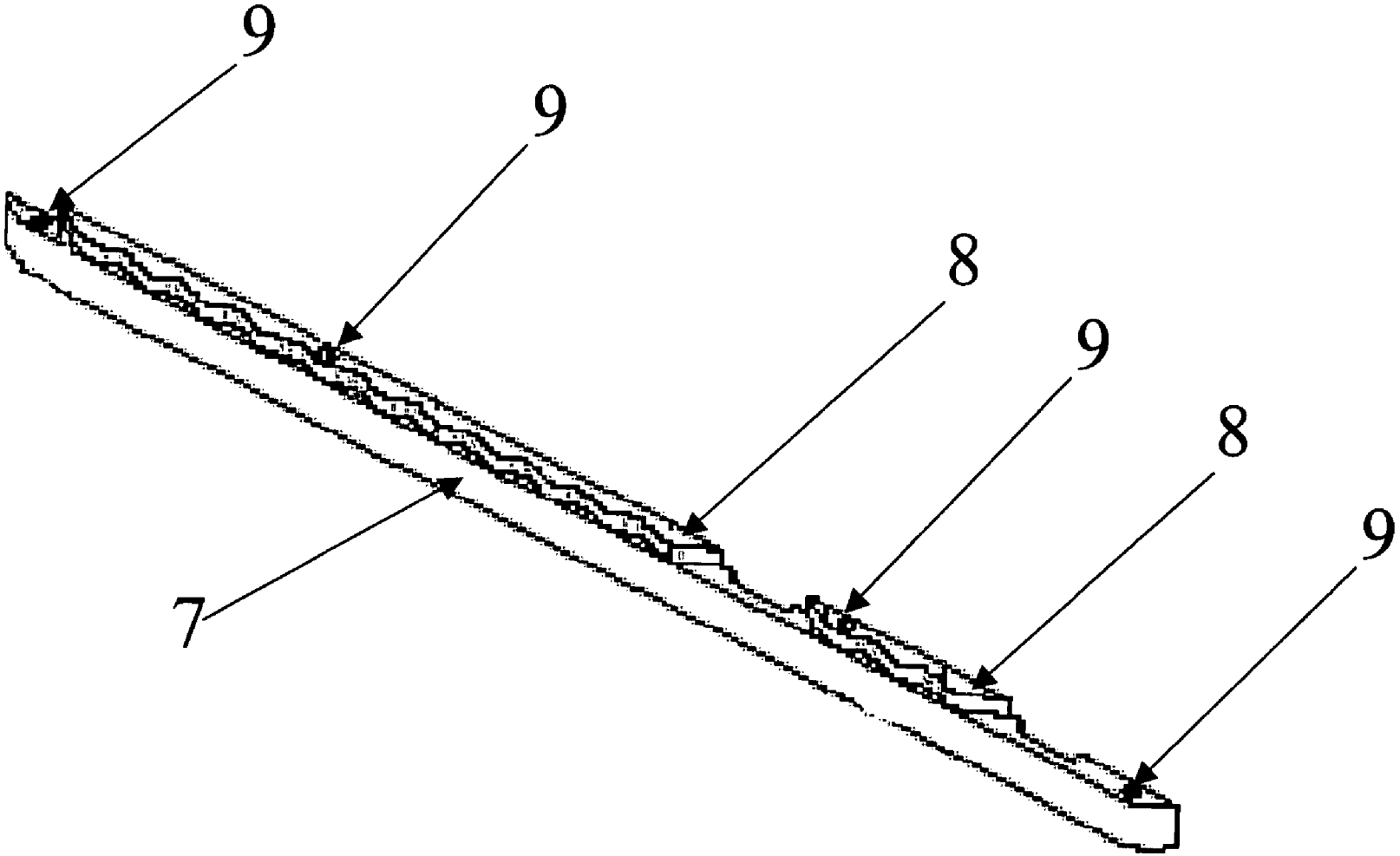
FIG. 4 shows the test vessel agitator assembly.

The test vessel agitator 3 is shown in more detail in FIG. 4. The support element 7 is a rigid structure upon which the agitator elements 8 are mounted. The agitator elements 8 may be a single piece or multiple pieces that allow contact with the test vessel holders 6. The test vessel agitator 3 is preferably attached to the transportation assembly base 1 by fasteners 9 located along the length of the agitator elements 8 and the support element 7. The agitator elements 8 are preferably made of a rigid material that has ridges and troughs along the horizontal length. The agitator elements 8 function to provide a series of "bumps" that bump the test vessels horizontally as they are transported linearly by the conveyor element 2.

Figure 5:
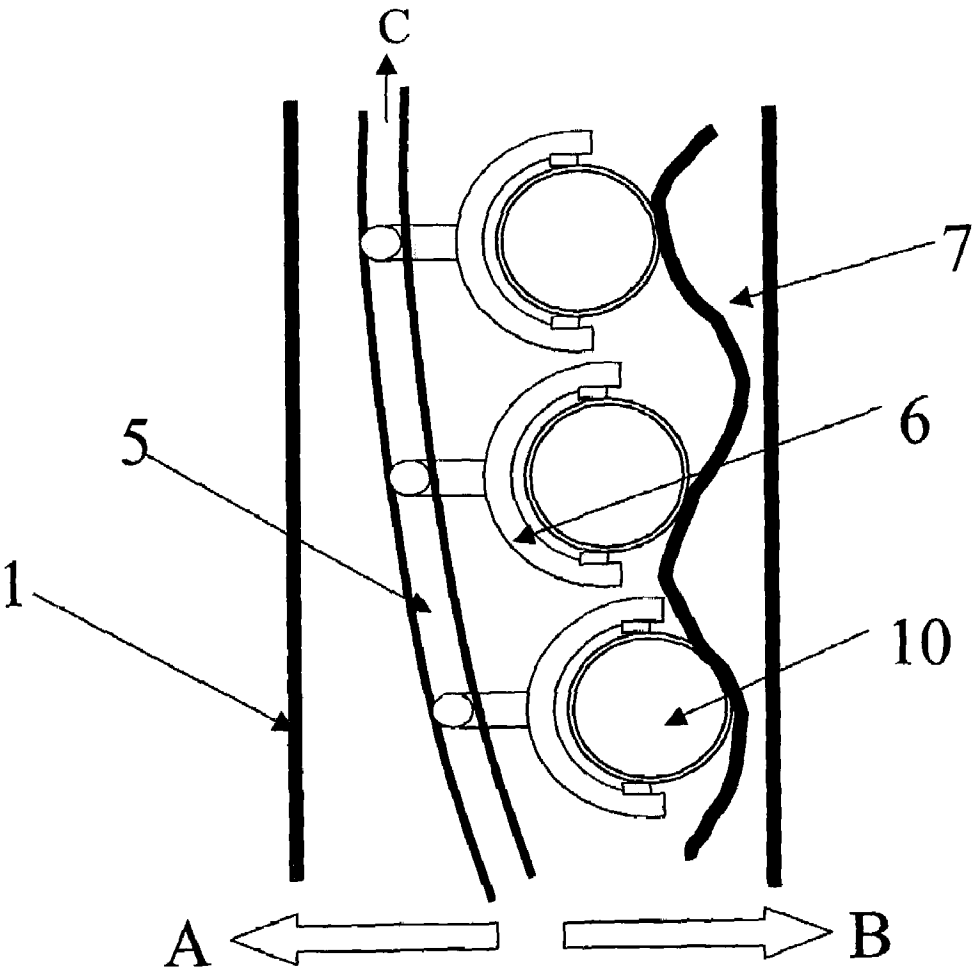
FIG. 5 shows the motion of the test vessel within the transportation assembly as it is moved along the agitator assembly.

FIG. 5 shows the performance of the test vessel agitator 3 as the conveyor element 2 moves. The belt 5 travels in the direction indicated by the arrow C. As the belt 2 moves, the test vessels 10 held by test vessel holders 6 move side to side as indicated by arrows A and B while being transported in the direction of arrow C. This side to side motion of the test vessels 10 causes the contents to be shaken while it is moving within the transportation assembly 11. Movement of the test vessels 10 as described by arrows A and B is approximately perpendicular to the movement of the conveyor element 2 described by arrow C.

In a preferred embodiment, the transportation assembly 11 can be positioned within an incubator (not shown) inside an automated immunoassay analyzer. Thus, as the test vessels are being incubated, they can be agitated passively simply by linear movement using the conveyor element 2. The base 1 could serve as an insulated portion of the incubator (not shown).

While movement of the conveyor 2 is shown in direction C in FIG. 4, it should also be understood that in some applications the conveyor 2 may move in forward and reverse directions, with each direction of movement causing agitation by deflection of the vessels in the A and B directions. FIG. 5 also shows the agitator elements 8 can have varying sloped troughs and projections although the preferred embodiment is to match the maximum number of vessels to the number of bumps thus achieving a better density of shaking. Having varying distances between troughs or projections as well as varying depths for the troughs can assist in having a more random agitation. However, it should be clear that the projections and troughs could also be uniform in character within the practice of this invention. Or, in some applications, the agitator elements 8 might be configured to provide lighter or harder agitation effects at different locations along the transportation assembly 11 by having projections and troughs of less extreme and more extreme variances (distance between bottom of trough and peak of projection), respectively.

The passive agitation of this invention might also be employed in other chemical analyzers which would benefit from having contents of vessels be agitated to assure proper mixing of the vessel contents after addition of reagents.

While the invention has been described in terms of a single preferred embodiment, those skilled in the art will recognize that the invention can be practiced with modification within the spirit and scope of the appended claims.

What is claimed:

1. A vessel agitator, comprising:

a plurality of vessel holders, each of said plurality of vessel holders constructed and arranged for removably holding a vessel;

a vessel conveyor constructed and arranged to move said plurality of vessel holders along a path having at least one substantially linear section; and a vessel contact agitator constructed and arranged such that when a vessel is held by at least one of said plurality of vessel holders, and is conveyed by said vessel conveyor along said path, said vessel contact agitator contacts said vessel at a plurality of contact locations along said path in a manner that displaces said vessel at each contact location in a direction perpendicular to the direction of the path at that contact location, wherein said vessel conveyor is constructed and arranged to move said at least one vessel holder such that said vessel contacts at least one of said plurality of contact locations of said vessel contact agitator a selectable number of times wherein at least one of said vessel holders is a U-shape structure.

2. The vessel agitator of claim 1 wherein the vessel contact agitator includes a plurality of at least three projections, each located at a corresponding one of said contact locations, and includes a plurality of at least three troughs, each located at a corresponding one of said contact locations, said projections and troughs being constructed and arranged such that each of said projections displaces said vessel in a first direction perpendicular to the path at the projection's location of projection, and such that each of said troughs displaces said vessel in a direction perpendicular to the path at the tough's location, and substantially opposite to the direction that projections adjacent to the trough displace said vessel.

3. The vessel agitator of claim 2 wherein the spacing differs between different adjacent ones of said projection locations.

4. The vessel agitator of claim 2 wherein the spacing differs between different adjacent ones of said trough locations.

5. The vessel agitator of claim 2 wherein the spacing is the same between different adjacent ones of said projection locations, such that the vessel is agitated in a periodic manner while being conveyed.

6. The vessel agitator of claim 1, wherein said vessel conveyor comprises a first rotatable wheel, a second rotatable wheel, and an endless belt engaged with said first rotatable wheel and second rotatable wheel, wherein said vessel holders are attached to said endless belt.

7. The vessel agitator of claim 1, wherein said conveyor is constructed and arranged such that said vessel travels in the same direction each time it contacts said at least one of said plurality of contact locations of said vessel contact agitator.

8. The vessel agitator of claim 1, wherein said conveyor is constructed and arranged to be moving said vessel in a first direction along said path when it makes a first contact with said at least one of said plurality of contact locations and be moving said vessel in a direction opposite said first direction second when it makes a subsequent contact with said at least one of said plurality of contact locations.

* * * * *